United States Patent [19]

Koberstein

[11] 4,333,290

[45] Jun. 8, 1982

[54] STRUCTURAL MEMBER FOR INSTALLATION SYSTEM

[75] Inventor: Michael V. Koberstein, Scottsdale, Ariz.

[73] Assignee: Arizona Diversified Products, Inc., Phoenix, Ariz.

[21] Appl. No.: 37,539

[22] Filed: May 10, 1979

[51] Int. Cl.[3] ..... E04B 1/88; E04B 2/28

[52] U.S. Cl. ..... 52/376; 52/309.2; 52/407; 52/508

[58] Field of Search ..... 52/368–374, 52/363, 309.7, 714, 344, 345, 404, 407, 508

[56] References Cited

U.S. PATENT DOCUMENTS

| | | | |
|---|---|---|---|
| 1,806,837 | 9/1931 | Boyle | 52/351 |
| 2,309,420 | 1/1943 | Taylor | 52/351 |
| 3,401,494 | 9/1968 | Anderson | 52/363 |
| 3,545,152 | 12/1970 | Knohl | 52/372 |

FOREIGN PATENT DOCUMENTS

| | | | |
|---|---|---|---|
| 7509981 | 2/1977 | Netherlands | 52/404 |

*Primary Examiner*—John E. Murtagh
*Attorney, Agent, or Firm*—Gregory J. Nelson

[57] ABSTRACT

An elongate metal furring strip for an insulation system for attaching cellular insulation to a masonary wall having the strip formed in a general U-configuration. The metal strip has an integral spacer so a fastening portion of the strip is elevated above the surface of the insulation sheet providing for a dead air space when a finishing panel is attached to the strip. In the preferred embodiment, the spacer comprises a filler of insulative material extending between the legs of the strip.

5 Claims, 10 Drawing Figures

STRUCTURAL MEMBER FOR INSTALLATION SYSTEM

This invention relates to a metal furring member for use in building construction and more particularly relates to a metal furring strip or channel for retaining insulation sheets and supporting either interior or exterior wall components in an assembly including a dead air space.

Various insulation systems are known in the construction field. Many of these insulation systems incorporate the use of polystyrene or polyurethane foam sheets or sheets made of other low density synthetic cellular material to provide a thermal barrier. These sheets can be secured or attached to masonary walls in various ways generally utilizing mechanical fasteners. The use of adhesives has generally not been acceptable as the adhesives are expensive, inconvenient to apply and do not always have sufficient strength to secure the sheets in place. For these reasons, the use of adhesives has not gained wide acceptance in the industry.

A more accepted method of attaching insulation sheets, such as low density synthetic cellular material, incorporates the use of some type of metal furring strip. The metal furring strip is used to secure the insulation sheet to a block or masonary wall. A wall panel, such as gypsum board, wallboard, plywood or the like is, in turn, secured to the metal furring channel. A system of this general type is shown in U.S. Pat. No. 3,401,494 which is directed to the method and fastening structure for securing sheets of polystyrene foam to a concrete wall. The metal fastening structure is channel shaped having serrated edges which can be pressed into the sheet of polystyrene foam flush with the face of the sheet of foam. The metal fastening structure as shown in the patent, is nailed or secured by power driven pins to the concrete wall and drywall construction is secured to the metal fastening structure over the face of the polystyrene sheets by screws.

Another method which has gained acceptance in the industry is shown in U.S. Pat. No. 3,252,189 which is generally designated a Z-clip system. In this patent an elongated unitary Z-shaped furring member has one flange of the furring member secured to the masonary wall and the other flange overlies and retains the insulation panels. Wallboard or finishing panels can then be secured over the face of the insulation panels by driving fasteners through the panels and through the underlying flanges.

The Z-clip system, while effective, has several deficiencies. The Z-clip system provides a direct thermal bridge through the clip and fasteners to the interior of the building. The flange to which the interior finishing panels are secured are supported only at one edge so adequate support for the panel is not always provided.

In view of the foregoing, the present invention provides a convenient and economical metal furring strip and system for securement of wall components to a wall including a dead air space resulting in a completed system with a substantially increased R factor (thermal resistive) with no additional insulation or components being required. Briefly, according to the present invention, an elongate metal furring strip is provided having a bight section and opposite depending legs. The elongate channel is placed in direct abutment with insulation sheets and a fastener, such as power driven nail can be driven through the bight section of the channel and into the concrete wall to secure the insulation sheets against the concrete wall. The elongate metal furring strip includes a spacer elevating the bight section of the channel away from the face of the insulation sheets. The interior finishing panels, such as gypsum board, are secured to the metal furring strips by appropriate fastener such as screws extending through the finishing panels into the bight section of the strip. In the completed assembly, a dead air space is provided between the exterior face of the insulation sheet and the interior face of the finishing sheet substantially increasing the R value of the completed structure without any increase in thickness of insulation material. In the preferred embodiment, the spacer comprises a low density synthetic cellular resin material extending between opposite legs of the channel and having an effective depth the depth of the channel legs.

The other advantages and objects of the present invention will become apparent from the following description, claims and drawings in which:

Figure 1:
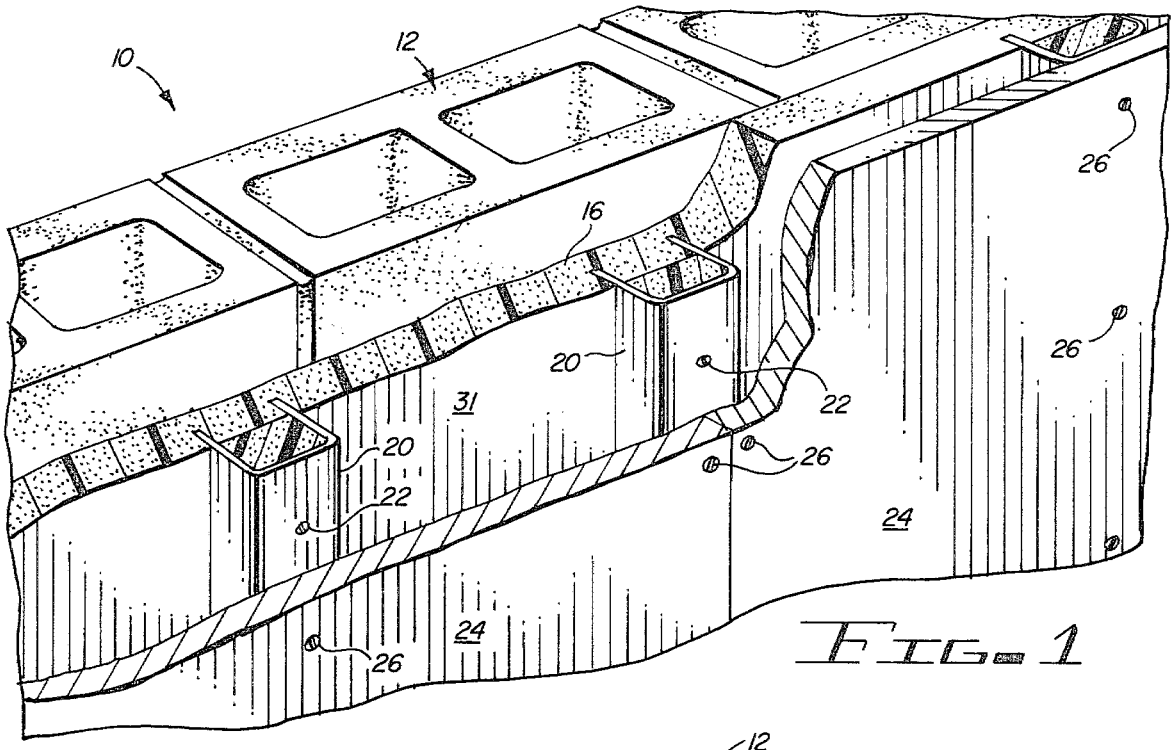
FIG. 1 is a perspective view of a portion of a wall system embodying the present invention.

Turning now to the drawings, FIG. 1 illustrates the insulation system of the present invention generally designated by the numeral 10. The insulation system is shown in connection with a masonary wall 12 which may be block as illustrated and which also may be stone or concrete or the like. The interior face of the blocks 14 are covered with insulation material 16 which is shown as a low density cellular resin material, such as polystyrene or polyurethane, supplied in sheet form. The purpose of the insulation sheet 16 is to increase the thermal resistance and reduce the heat load on the interior of the building. Metal furring strips 20 are applied at the interior surface 18 of sheets 16 at spaced apart locations. The construction of the metal furring strip will be discussed in more detail hereafter and serves to secure the insulation sheets 16 to the masonary wall 12 by fasteners 22 which typically may be power driven nails extending through the channel into and penetrating the wall 12.

Interior finishing sheets 24, shown as conventional wallboard panels, are secured to the metal furring strips 20 by a plurality of fasteners 26 which may be self-tapping screws. In each instance, the joints between the adjacent panels 24 may be covered with an appropriate joint compound, taped and provided with a suitable interior finish or texture. Alternatively, finishing panels 24 may be other materials such as plywood or sheets of paneling. The construction of the furring strip 20 permits the interior finishing panels 24, in the installed position, to be elevated from the interior surface 18 of the insulation panels 16 leaving a dead air space 30. The inclusion of the dead air space 30 between the insulation panels 16 and the gypsum or finishing panels 24 substantially increases the thermal resistance in the completed assembly 10.

Figure 3:
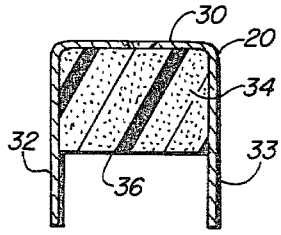
FIG. 3 is a cross sectional view through the metal furring strip of the present invention.
Figure 4:
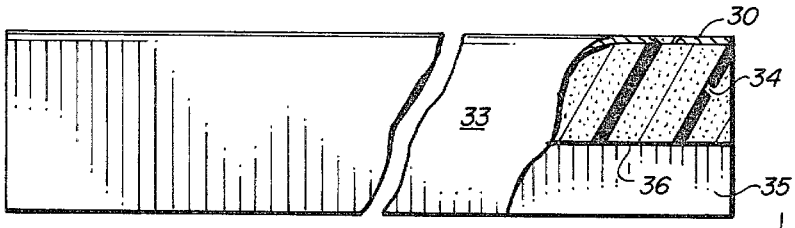
FIG. 4 is a side elevational view of the furring strip shown in FIGS. 1 to 3.

The details of the metal furring channel 20 are illustrated in greater detail in FIGS. 3 and 4. Metal furring strip 20 may be fabricated from a single elongate sheet of sheet metal typically guaged by a stamping or other similar metal forming technique. The metal furring strip has a transverse bight section 30 and opposite depending legs 32 and 33. For a conventional installation, the width of the bight section 30 is approximately $1\frac{3}{4}''$ wide. The depending legs 32 and 33 each have a depth of approximately one inch. A spacer member 34 extends in the area transversely between opposite legs 32 and 33 having a bottom surface 36 generally parallel to bight section 30. The overall depth of spacer 34 is less than the length or the depth of legs 32 and 33 so that a distal portion 35 of these legs extends beyond the bottom surface 36 of the spacer 34. Spacer 34 may be of any suitable material such as wood, plastic and preferably is a light-weight material such as a low density synthetic cellular material as polystyrene or polyurethane poured into the channel in a fluid state and allowed to harden.

Figure 2:
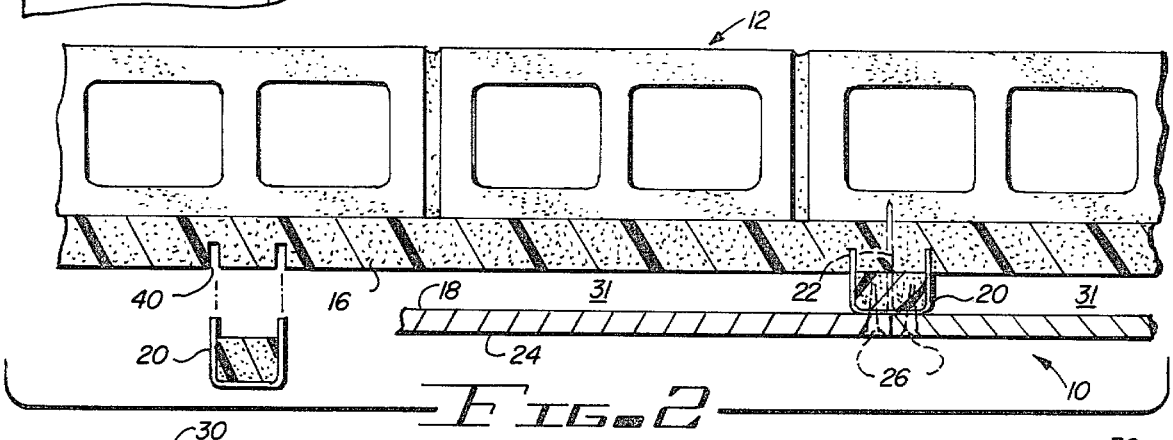
FIG. 2 is a cross sectional view in a horizontal plane illustrating the wall assembly as shown in FIG. 1.

In the system 10 as shown in FIG. 1 and 2, the insulation sheets 16 are preferably supplied with parallel spaced apart grooves 40 spaced apart corresponding to the spacing of legs 32 and 33. When the system is installed the furring strips 20 are placed with the distal portion 35 of legs 32 and 33 placed in the grooves 40. Sufficient frictional interference exists between the legs and the grooves to temporarily secure the strips in place during the nailing process. The installer simply pushes the legs 32 and 33 of the strips in place and accomplishes permanent securement by driving fasteners 22 through the bight section of the strip, through the spacer 34 and through the subjacent polystyrene sheet 16 to penetrate the block wall 12 securing the strip in place and concurrently securing the sheets 16 to the face of the block wall. Spacer 34 establishes the depth of the dead air space 30 between the face of the sheets 16 and the interior face of the finishing panels 24. In the event that the insulation panels 16 are not provided with pre-established grooves, the longitudinal edges of legs 32 and 33 can be serrated in known manner to facilitate puncturing of the sheets. Generally, the furring strips are applied at pre-established spaced apart locations, such as on 16" or 24" centers. The channels may be applied vertically or horizontally or can be applied in both directions, particularly in around the doors, windows and similar openings.

Figure 5:
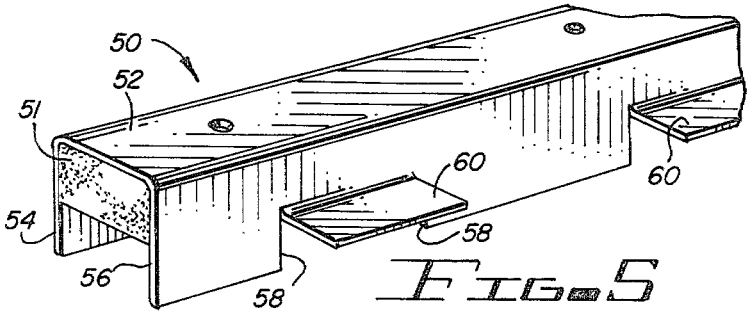
FIG. 5 is a perspective view of an alternate embodiment showing another form of the metal furring strip.
Figure 6:
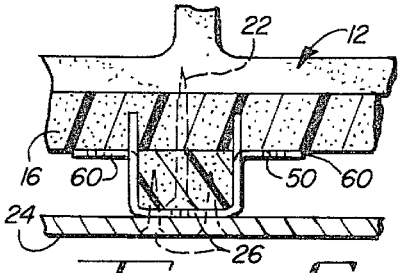
FIG. 6 is a cross sectional view in a horizontal plane illustrating the installation of the metal furring strip of FIG. 5.

FIGS. 5 and 6 show another variation of the metal furring strip generally designated by the numeral 50. In this embodiment, the furring strip 50 again is generally elongate member having a bight or back section 52 and opposite depending legs 54 and 56. At spaced apart longitudinal locations opposite sections of legs 54 and 56 have been vertically separated at cuts 58 forming a tabular sections 60 which are bent, either inwardly or outwardly, to approximately 90° with respect to the plane of legs 54 and 56. Tab 60 then forms a spacer to establish a dead air space 30 as shown in FIG. 6. An appropriate reinforcing filler 51 may be inserted in the area of the strip terminating at the plane of tabs 60.

When the elongate metal furring strip 50 is pressed in place in the insulation panel 16, the metal tab 60 limits the insertion of the legs 54 and 56 into the insulation sheet 16. The metal furring strip 30 is again secured to the concrete wall 12 by nail or other fastener 22 and the interior finishing sheet 24 are secured to the bight 52 of the furring strip by screws or other fasteners 26. Note the depth of penetration of the distal or terminal part of legs 54 and 56 is limited by the location of tabs 60 and is selected so the depth of penetration is less than the total thickness of insulation panels 16.

It is noted that in reference to this embodiment of the invention and other embodiments the same reference numerals have been used for convenience to identify the same or similar elements.

Figure 7:
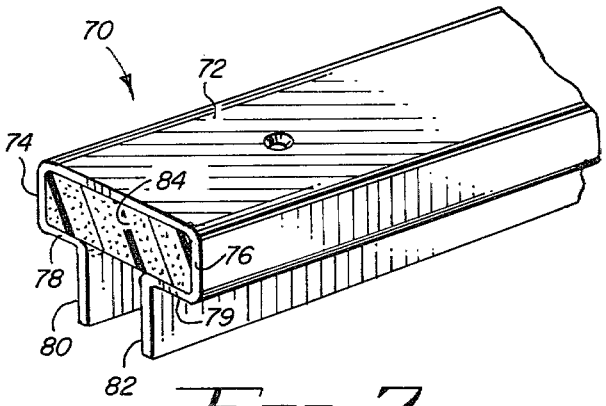
FIG. 7 is a perspective view illustrating another embodiment of the furring strip of the present invention.
Figure 8:
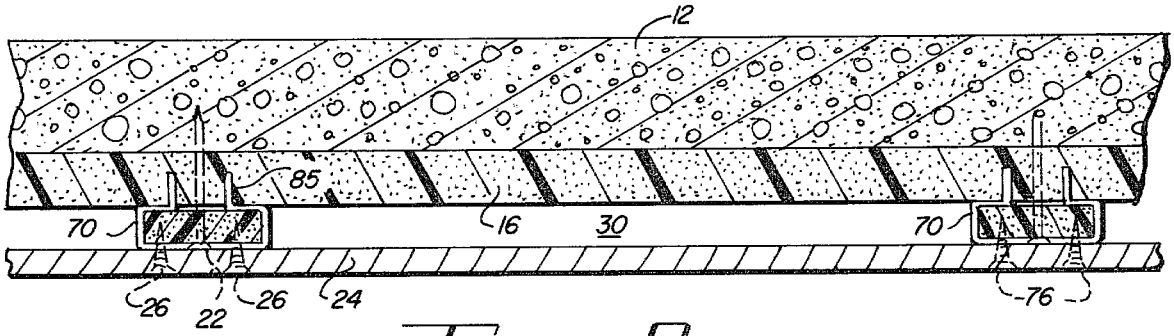
FIG. 8 is a cross sectional view in a horizontal plane illustrating the installation of the furring strip as shown in FIG. 7.

FIGS. 7 and 8 show still another embodiment of the present invention generally designated by the numeral 70. The furring strip 70 is generally an elongate having a horizontal back or bight section 72 and opposite side members 74 and 76. The vertical height of sections 74 and 76 determine the height of the dead air space in the assembled wall system. The bottom portion of sides 74 and 76 are inwardly turned at 78 and 79 forming flange sections which terminate at downwardly depending leg portions 80 and 82. The interior of the channel may be filled with an appropriate reinforcing material 84 such as low density cellular material, wood, plastic or other filler to add rigidity to the strip.

The strip is inserted as shown in FIG. 8 with the adjacent legs 80 and 82 extending into the insulation sheet 16 at spaced apart grooves 85. Fastener 22 extends into and penetrates the masonary wall 12 securing the channel and insulation sheets in place. Finishing sheets or panels 24, shown as gypsum board, are in turn fastened to the furring strip 70 by means of self tapping screws 26.

Figure 9:
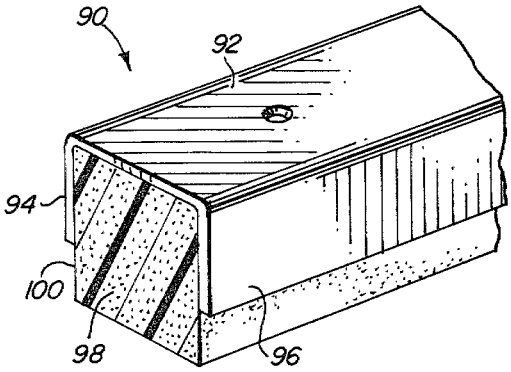
FIG. 9 is a perspective view of still another embodiment of the metal furring strip of the present invention.
Figure 10:
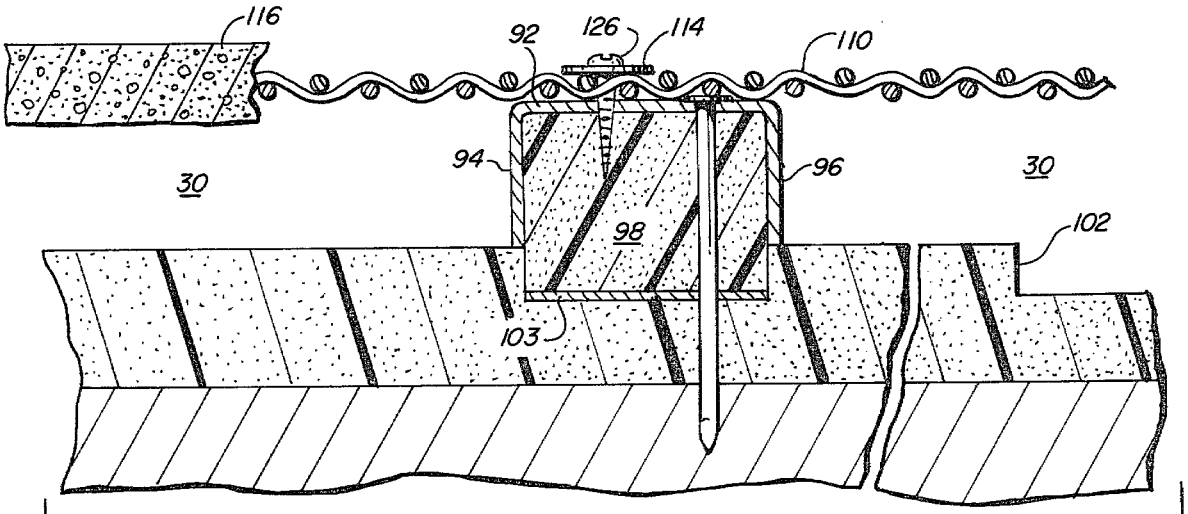
FIG. 10 is a horizontal cross sectional view illustrating the installation of the furring strip of FIG. 9 as applied to the exterior of a masonary wall.

FIGS. 9 and 10 illustrate still another embodiment of the present invention generally designated by the numeral 90 and applied as an insulation system to the exterior of a building. The furring strip again is formed having a bight section 92 and opposite depending legs 94 and 96 configured in a general U-shape. A spacer 98 extends longitudinally and is inserted between legs 94 and 96. Spacer 98 is shown as being generally rectangular in cross section having a depth greater than legs 94 and 96 so that a portion 100 of the spacer extends below the terminal edges of the opposite legs 94 and 96.

FIG. 10 illustrates the installation of the furring strip designated by the numeral 90. As seen in FIG. 10, the present invention has been applied to the exterior of a masonary wall 12. Insulation sheets shown as polyurethane or polystyrene sheets 16 have been applied to the exterior of masonary wall 12. At predetermined intervals, spaced apart parallel grooves 102 have been provided in the panels 16. The grooves 102 correspond in width to the width of spacer 98 in the channel. Similarly, the depth of the grooves 102 corresponds approximately to the depth of the section 100 of the spacer projecting below legs 94 and 96. Metal furring strips 90 are secured in place in grooves 102 by frictional engagement between the spacer and the grooves 102 or, in some cases, spot gluing at predetermined locations 103 along the length of the groove may be provided to assist in adherence between the strip and the sheet 16. Power driven nails 22 are secured to the concrete wall 12 through the bight section 92 of the channel. This also secures the subjacent insulation sheets 16 in place. The legs 94 and 96 of the metal furring strip 90 do not penetrate the insulation sheet 16 but rest on the outer surface. A dead air space 30 is provided between the exterior surface of panel 16 and the metal lath 110 applied or secured to the furring strips 90 by self tapping screws 126 and a suitable washer 114. Metal lath 110 is well known in the art and comprises an expanded metal support for application of plaster or other finishing materials 116. Thus it will be seen the invention has application to the insulation of building exteriors using finishing materials other than paneling or wallboard.

It will be seen from the foregoing, that the present invention provides a unique and efficient system for increasing the thermal efficiency of a wall system. The system increases the over-all thermal resistance by the inclusion of a dead air space within the wall and does not require any additional or new components or additional thickness of insulation. Typically the R value of a wall may be increased by as much as three or four by simply providing a half-inch dead air space. With the system of the present invention any thermal bridge or conductivity through metal components minimized as the finishing surface is secured to the metal strip by screws which do not penetrate into the concrete wall.

It will be obvious to those skilled in the art to make various changes modifications and alterations to the structural member and wall assembly disclosed herein. To the extent that these variations, changes and modifications do not depart from the spirit and scope of the appended claims, they are intended to be covered thereby.

I claim:

1. An insulation system comprising:

(a) a masonary wall;

(b) at least one cellular insulation sheet at the surface of said wall;

(c) an elongate generally U-shaped metal strip substantially co-extensive with a dimension of said insulation sheet, said strip having a bight section and at least one depending leg;

(d) insulative spacer means integrally formed with said strip adapted to elevate the bight section of said strip from the face of said insulation sheet;

(e) first fastener means extending through said metal strip into said wall securing said strip against said sheet with said spacer engaging said sheet and said bight portion at said strip elevated from the surface of said sheet;

(f) a finishing panel engaging the bight of said strip; and (g) second fastener means securing said finishing panel to said metal strip with a dead air space therebetween, said dead air space being established between said finishing panel and said insulation sheet by said spacer means elevating the bight section of said strip from the face of said insulation sheet thereby increasing the overall R value of the wall system without the requirement of additional insulation.

2. The insulation system of claim 1 wherein said strip has oppositely spaced legs depending from the bight and said spacer means are formed by inclusion of an insulation member extending transversely between the legs of the strip.

3. The insulation system of claim 1 wherein said spacer means is formed by tab means formed in said leg members and extending generally at right angles thereto.

4. The insulation system of claim 1 wherein said spacer means is formed in said legs, said legs having a first section depending from said bight generally perpendicular thereto, a second section extending inwardly and generally parallel to said bight and spaced apart therefrom and a distal portion extending from the ends of said second portion and generally perpendicular thereto.

5. The insulation system of claim 4 wherein an insulative material extends at least between the first section of said legs.

* * * * *